United States Patent [19]

Wills

[11] 4,075,865

[45] Feb. 28, 1978

[54] APPARATUS FOR CONTROLLING CONDENSER PRESSURE IN A REFRIGERATION SYSTEM

[75] Inventor: Frank E. Wills, York, Pa.

[73] Assignee: Borg-Warner Corporation, Chicago, Ill.

[21] Appl. No.: 637,927

[22] Filed: Dec. 5, 1975

[51] Int. Cl.[2] ..... F25D 17/00

[52] U.S. Cl. ..... 62/183; 318/334; 318/472

[58] Field of Search ..... 62/180, 183, 184, 186; 236/DIG. 9; 318/334, 472

[56] References Cited

U.S. PATENT DOCUMENTS

| | | | |
|---|---|---|---|
| 3,196,629 | 7/1965 | Wood | 62/183 |
| 3,289,429 | 12/1966 | Beard | 62/183 |
| 3,353,078 | 11/1967 | Maynard | 318/334 X |
| 3,366,167 | 1/1968 | Dapper | 165/32 |
| 3,385,077 | 5/1968 | Marsteller | 62/180 |
| 3,390,539 | 7/1968 | Miner | 62/184 |
| 3,415,071 | 12/1968 | Kompelien | 62/158 |
| 3,444,698 | 5/1969 | Lorenz | 62/128 |
| 3,454,078 | 7/1969 | Elwart | 318/334 X |
| 3,478,532 | 11/1969 | Cootey et al. | 62/184 |
| 3,514,967 | 6/1970 | Vander Molen | 62/180 |
| 3,530,683 | 9/1970 | Watkins | 62/89 |
| 3,613,391 | 10/1971 | Harter | 62/184 |
| 3,633,376 | 1/1972 | Milner | 62/181 |
| 3,821,726 | 6/1974 | Chang et al. | 340/239 R |

FOREIGN PATENT DOCUMENTS

| | | | |
|---|---|---|---|
| 4,614,927 | 4/1971 | Japan | 62/180 |

*Primary Examiner*—William R. Cline
*Assistant Examiner*—Richard Gerard
*Attorney, Agent, or Firm*—James E. Tracy

[57] ABSTRACT

Constant condenser pressure is maintained in a refrigeration system by modulating the speed of at least one fan motor of an air-cooled condenser coil in response to the temperature of the refrigerant in the condenser coil, the speed varying directly with temperature. Motor speed variations are achieved by controlling the conduction time of a triac which couples the fan motor to a source of alternating voltage. The triac is triggered into conduction at a phase angle, following the beginning of each half cycle of the alternating voltage, determined by the charging rate of a timing capacitor which charges through a photosensitive transistor optically coupled to an LED. Variation of the refrigerant temperature in the condenser coil changes the light emission of the LED and this in turn varies the charging current translated to the capacitor. The greater the temperature, the greater the charging current and the faster the triac conducts following the start of each half cycle.

1 Claim, 1 Drawing Figure

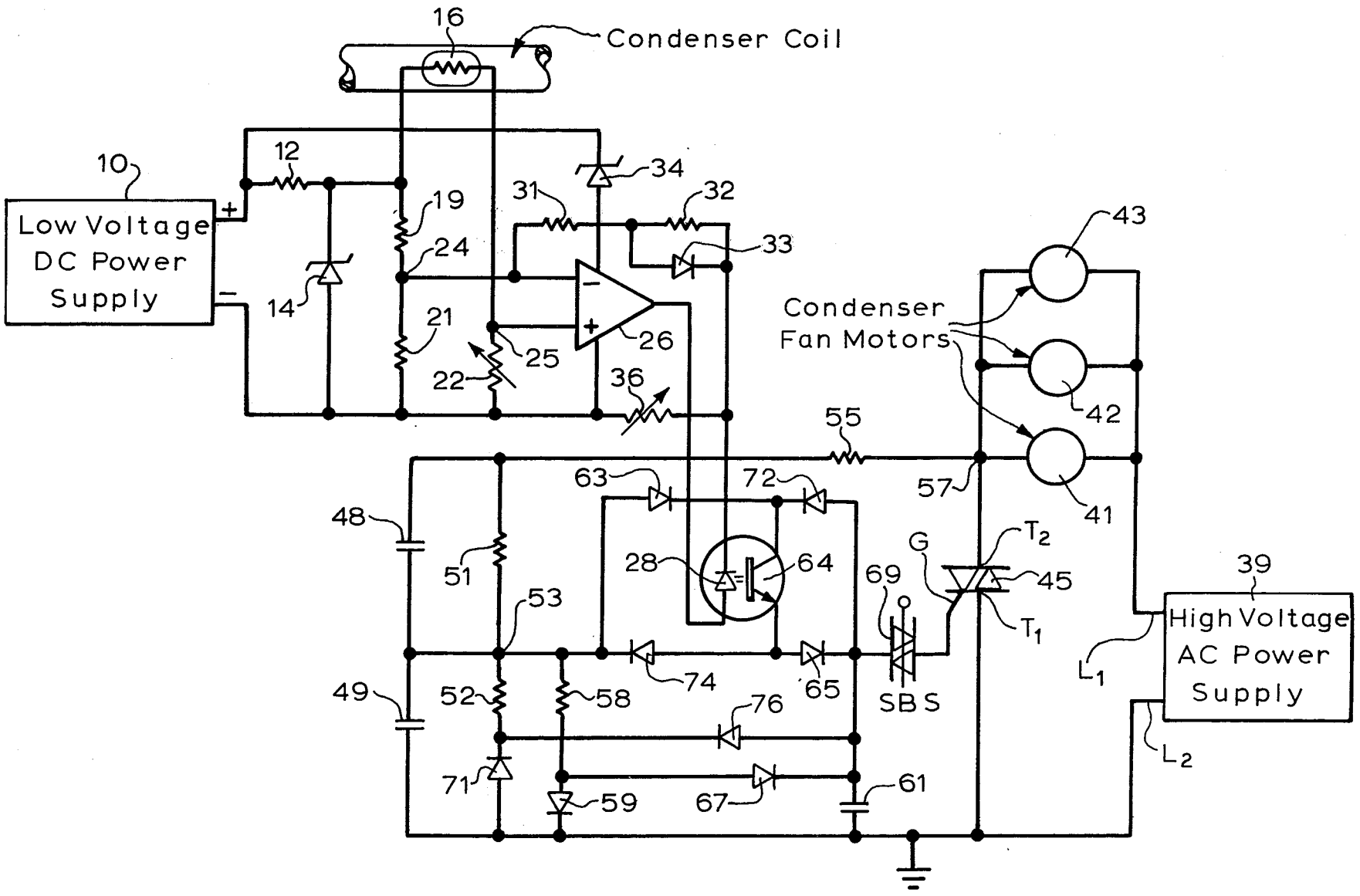
High Voltage AC Power Supply
Low Voltage DC Power Supply
Condenser Coil
Condenser Fan Motors
SBS
39
L1
L2
43
42
41
45
T2
T1
G
57
55
69
61
64
65
72
76
67
74
28
63
58
59
53
51
52
71
48
49
33
32
34
26
36
31
25
22
16
19
24
21
12
14
10

APPARATUS FOR CONTROLLING CONDENSER PRESSURE IN A REFRIGERATION SYSTEM

BACKGROUND OF THE INVENTION

This invention relates to a control system for controlling the condenser pressure in a refrigeration system. While the invention may be employed in a variety of refrigeration systems, it is particularly useful in all-weather air conditioning equipment required to operate in the presence of broad range of outside ambient temperatures, and will be described in that environment.

The condenser coil of an air conditioning system is usually located out-of-doors or in heat exchange relation with outdoor air and is therefore subjected to widely varying ambient temperatures. If the system operates during cold weather, the outdoor temperatures may drop sufficiently low to materially reduce the condensing temperature of the refrigerant in the condenser coil. This produces a corresponding reduction in head pressure on the high pressure side of the refrigeration system, resulting in a decreased pressure differential across the thermal expansion valve or other refrigerant metering device in the system. Because of the reduced pressure difference across the metering device, less refrigerant flow from the condenser to the evaporator. The capacity of the refrigeration system is accordingly reduced and the cooling load placed on the evaporator may not be satisfied.

In some instances, the reduction in head pressure at low ambient temperatures may result in the evaporator coil being cooled to a temperature below freezing, allowing condensed moisture to freeze on the evaporator coil. As the layer of ice builds up on the evaporator coil, the coil becomes insulated from the refrigeration load and a further reduction in system capacity occurs.

Systems have been developed for preventing a pressure drop on the high pressure side of the refrigeration system, thereby to maintain the minimum pressure differential across the metering device required for efficient operation, by reducing the speed of at least one fan motor for the condenser as the ambient temperature falls. The volume of air blown across the condenser coil therefore decreases and this limits the amount of heat that can be extracted from the refrigerant as it passes through the condenser coil, insuring that the refrigerant temperature, and consequently its pressure, does not fall below the required minimum. With the pressure on the high side of the system at or above the minimum, the pressure difference across the expansion or metering device will be at or above the level necessary for efficient operation.

The present invention also maintains a minimum head pressure by keying the condenser fan speed to condensing temperature. These functions are achieved, however, by means of a control system considerably simpler, more reliable, and less expensive than those developed heretofore. Moreover, the present control system exhibits a significant improvement in performance over the prior systems.

SUMMARY OF THE INVENTION

The control system of the invention modulates the speed of a variable speed fan motor, of an air-cooled condenser coil in a refrigeration system, in response to the temperature of the refrigerant in the condenser coil in order to maintain a substantially constant condenser pressure despite wide variations in condenser cooling air temperature. The control system comprises a light emitting diode or LED and means for varying the light intensity of the diode in response to the refrigerant temperature in the condenser coil. Optically coupled to the light emitting diode is a photosensitive transistor whose emitter-collector resistance is determined by the amount of light received from the diode. A timing capacitor, in series with the transistor, is coupled to an AC power supply. It charges, during each half cycle of the alternating voltage from the AC power supply, in response to charging current of an amplitude determined by the emitter-collector resistance of the transistor. A triac is coupled in series with the AC power supply and with the condenser fan motor. Finally, the control system of the invention comprises means controlled by the timing capacitor for triggering the triac into conduction at a phase angle, following the beginning of each half cycle, determined by the charging rate of the capacitor. As a result, the condenser fan motor is driven at a speed directly proportional to the temperature of the refrigerant in the condenser coil.

DESCRIPTION OF THE DRAWING

The features of the invention which are believed to be novel are set forth with particularity in the appended claims. The invention, together with further advantages and features thereof, may best be understood, however, by reference to the following description in conjunction with the accompanying drawing which schematically illustrates a control system, constructed in accordance with one embodiment of the invention, and the manner in which the control system is incorporated in a refrigeration system.

DESCRIPTION OF THE ILLUSTRATED EMBODIMENT

Consideration will initially be given to a portion of the control system that produces a signal representing the condensing temperature. Block 10 represents a relatively low voltage (for example, 30 volts) DC power supply. A regulated positive DC voltage (with respect to the negative output terminal of supply 10) appears at the junction of resistor 12 and zener diode 14 for application to one terminal of a temperature sensing thermistor 16 which is firmly secured to a portion of the condenser coil in heat exchange relation therewith in order to sense the temperature of the refrigerant in the condenser coil. One convenient way to attach the thermistor is to clamp or strap it around the refrigerant line. Thermistor 16 has a negative temperature coefficient so that its resistance is an inverse function of the condensing temperature and the head pressure in the refrigeration system. In other words, if the temperature of the refrigerant in the condenser coil increases, the resistance of thermistor 16 decreases.

Fixed resistors 19 and 21, thermistor 16 and adjustable resistor or potentiometer 22 form a wheatstone bridge. The set point of the control system, which is established by the adjustment of potentiometer 22, is the refrigerant temperature around which the system will throttle. Preferably, potentiometer 22 will be adjusted to establish the set point at approximately 100° F, with a throttling range between 95° and 105° F. When the temperature of the refrigerant in the condenser coil is 100° F, the resistance of thermistor 16 will be of a magnitude appropriate to balance the bridge; namely, the voltage drop across thermistor 16 will equal that across resistor 19, and the voltage drop across adjustable resistor 22 will be equal to that across resistor 21. Hence, when the bridge is balanced circuit junctions 24 and 25 are established at the same DC potential level. Identical DC voltages are therefore applied to the negative and positive inputs of differential amplifier 26 when the refrigerant is at the set point temperature and the bridge is balanced.

Differential amplifier 26, which may take the form of a type 741 integrated circuit operational amplifier, produces a continuous output signal whose amplitude is proportional to the voltage difference between circuit junctions 24 and 25. If the refrigerant temperature in the condenser coil increases above the set point, the resistance of sensor 16 decreases and the DC voltage at junction 25, and consequently at the positive input of differential amplifier 26, increases in a positive direction with respect to the reference voltage at the negative input of the amplifier. As a result, the output current of amplifier 26 increases. On the other hand, if the refrigerant temperature falls below the set point temperature, the resistance of thermistor 16 increases and the voltage level at the positive input of amplifier 26 decreases relative to the reference level at the negative input. As a consequence, the output current of differential amplifier 26 decreases.

The output current of differential amplifier 26 flows through a light emitting diode or LED 28, the light emission of which is directly proportional to the current translated therethrough. the greater the output current from amplifier 26, the greater the light intensity. Hence, the amount of illumination of LED 28 is a direct function of the refrigerant temperature sensed by thermistor 16. Resistors 31 and 32 and diode 33 provide wave shaping of the output current of amplifier 26 so that it varies exponentially rather than linearly with respect to temperature changes. The reason for introducing the wave shaping will be appreciated later. Zener diode 34 merely applies a positive DC operating potential to differential amplifier 26. Potentiometer 36 permits calibration of the differential amplifier when connected to LED 28.

Turning now to the circuit controlled by the LED, block 39 represents a conventional AC power supply or source which provides, across line conductors $L_1$ and $L_2$, a single-phase alternating voltage having a relatively high magnitude (for example 220 volts or 440 volts) and a commutating frequency of 60 cycles per second or hertz. The instantaneous voltage on line conductor $L_1$ will alternate in generally sinusoidal fashion above (or positive) and below (or negative) relative to the instantaneous voltage found on line conductor $L_2$. For convenience of explanation, line conductor $L_2$ is established at a plane of reference potential or ground. Also for convenience the AC voltage provided by supply 39 will be called line voltage.

Since the invention may be employed with a condenser coil having several variable speed type fan motors, three such motors 41, 42 and 43 have been shown in the drawing. Preferably, each of fan motors 41, 42 and 43 is of the PSC or permanent split capacitance type. They are connected in parallel and the parallel combination is coupled to AC power supply 39 via a series-connected triac 45. In the absence of any applied voltages, the triac assumes its off condition in which a very high impedance exists between its main terminals $T_1$ and $T_2$ to effectively constitute an open switch. When a voltage of either polarity is impressed across the main terminals, triac 45 will remain non-conductive until gate or triggering current of appropriate magnitude is translated between the gate terminal G and the main terminal $T_1$ in either direction, where upon the triac turns on and permits current flow between terminals $T_1$ and $T_2$ in reponse to the voltage applied thereto and in the direction determined by the voltage's polarity. Once triac 45 is rendered conductive, a very low impedance is presented between its main terminals so that it essentially functions as a closed switch, as a consequence of which the full instantaneous voltage from AC power supply 39 will be applied to each of fan motors 41, 42 and 43. Conduction through the triac will continue even after the termination of the gate current so long as there is a potential difference across the main terminals. When the $T_1 - T_2$ voltage is reduced to zero, the triac therefore returns to its off state. Thereafter, when the voltage across the main terminals is increased from zero, conduction will not occur until gate current again flows between gate G and terminal $T_1$.

Since the triac automatically switches to its off condition each time the applied alternating voltage from supply 39 crosses its a.c. axis a.c. axis, at which time a zero potential difference exists between terminals $T_1 - T_2$, triggering current must be supplied to the gate at some instant followig the beginning of each half cycle or alternation if power supply 39 is to be connected to the fan motors for at least a portion of each half cycle. In other words, at the end of each half cycle of one polarity triac 45 assumes its non-conductive state. The polarity of the alternating voltage from source 39 then changes at the start of the next half cycle, thereby requiring retriggering at the gate before the triac turns on and $T_1 - T_2$ current flow takes place. The greater the time delay between the start of a half cycle and the turning on of the triac, the less the conduction time of the triac and the lower the RMS (root-mean-square) voltage applied to the fan motors. Since the operating speed of each motor is determined by the RMS voltage applied thereto, the speeds of all three motors may be changed simultaneously from zero to full RPM by varying the delay or phase angle between the beginning of each half cycle and the translation of gate current to triac 45. The conduction angle, or conduction duration, of the triac is equal, of course, to 180° minus the phase angle at which conduction begins. As will be explained, a triggering circuit controlled by LED 28, and consequently by thermistor 16, controls the phase angle so that the speed of the fan motors will be a direct function of condensing temperature and thus head pressure.

Capacitors 48 and 49 and resistors 51 and 52 constitute a frequency compensated capacitive voltage divider which provides at circuit junction 53 a relatively small portion of the line voltage from AC supply 39. The time constant of the RC combination 48, 51 therefore equals the time constant of the RC circuit 49, 52. Preferably, the voltage division ratio is 10:1 so that the AC voltage at junction 53 is only about 10% of the line voltage across conductors $L_1$ and $L_2$. Resistor 55 in conjunction with the capacitive voltage divider provide a dv/dt suppresion network, or what is commonly called a snubber network, across triac 45. In the absence of a snubber network across a triac, a fast rise in gate voltage may trigger the triac into conduction even though the gate threshold is not reached.

Of course, even though the line voltage is applied to the capacitive voltage divider and to resistor 55 via fan motors 41 – 43, those motors will not operate until triac 45 is fired into conduction. This obtains since a very small portion of the line voltage appears across the fan motors when they are in series with elements 48 - 55.

The operation of the triggering circuit for triac 45 may most easily be explained by analyzing the circuit in response to different instantaneous voltage conditions. Assume initially that the instantaneous voltage at the circuit junction 57, relative to ground, has just crossed its a.c. axis and is starting a positive half cycle. At that time, current flows from junction 57 to ground via the following path: resistor 55, resistor 51, resistor 58 and diode 59. A small replica of the positive-going voltage at junction 57 appears at junction 53 and causes charging current to flow to timing capacitor 61 over the following path: diode 63, the collector-emitter conduction path of photosensitive transistor 64 and diode 65. The amplitude of the charging current is dependent on the emitter-collector resistance of transistor 64 which in turn is determined by the light emission of LED 28 to which the transistor is optically coupled. LED 28 and transistor 64 are packaged together in a light-proof container and constitute an optically coupled isolator. The greater the light emission, the less the resistance of the transistor and the greater the charging current and consequently the charging rate.

As capacitor 61 begins to charge in a positive direction, if there is any negative voltage on the ungrounded terminal of capacitor 61 from the preceding negative half cycle, that negative voltage will be discharged immediately through diode 67 and resistor 58. This reset circuit insures that the charging of the capacitor during a positive half cycle always begins at zero voltage, thus eliminating any residual charge buildup and the hysteresis and dissymmetry associated therewith.

As timing capacitor 61 continues to charge, the instantaneous voltage at the ungrounded terminal of the capacitor increases in a positive sense until the threshold voltage of silicon bilateral switch or SBS 69 is reached, at which time the SBS breaks down and permits bidirectional current flow. Capacitor 61 therefore immediately discharges through SBS 69 and the conduction path between terminals G and $T_1$ of triac 45. This gate current will be of sufficient magnitude to fire the triac into conduction so that fan motors 41 - 43 will be directly connected, via triac 45, to AC power supply 39 for the remainder of the positive half cycle. The phase angle at which the triac begins to conduct will therefore be determined by the time required for capacitor 61 to charge to the breakdown voltage of SBS 69, and that charging time will be inversely proportional to the refrigerant temperature sensed by thermistor 16. The greater the charging rate, the greater the conduction angle, the greater the RMS voltage applied to the fan motors and the greater the fan speed.

If, for example, the charging current supplied to capacitor 61 during the positive half cycle is sufficiently low that SBS 69 does not break down until the positive half cycle is three-fourths completed, the phase angle at which conduction occurs would be 135°, and the triac would conduct for only about 45° of the 180° half cycle. The fan motors would thus be driven at a relatively slow speed. On the other nand, if the charging current is substantially greater and the triac is fired into conduction at a phase angle around, for example, 20°, the fan motors will rotate at a much greater speed since they will be connected to AC supply 39 for 160° of each 180° half cycle.

The control system operates in similar fashion during each negative half cycle. When the instantaneous voltage at circuit junction 57 has just completed a positive half cycle and is beginning to go negative with respect to ground, current flows from ground to junction 57 over the following path: diode 71, resistor 52, resistor 51 and resistor 55. The small negative-going replica at junction 53 causes charging current to flow to capacitor 61 in the direction from the ungrounded terminal of the capacitor to junction 53 via the following path: diode 72, the collector-emitter path of photosensitive transistor 64 and diode 74. At the very beginning of the negative half cycle, and positive voltage on the ungrounded terminal of capacitor 61 from the preceding positive half cycle will be discharged immediately via diode 76 and resistor 52. In this way, the ungrounded terminal of capacitor 61 will always start at zero voltage at the start of a negative half cycle.

As the instantaneous voltage at junction 57 continues to increase in a negative direction, the voltage at the ungrounded terminal of capacitor 61 also increases in a negative sense until the negative voltage applied to SBS 69 reaches the threshold or breakdown voltage of the device whereupon it fires and allows the capacitor to discharge through the conduction path between terminals $T_1$ and G and in the direction from $T_1$ to G. The discharge current triggers the triac into conduction, thereby connecting the fan motors to power supply 39 for the remainder of the negative half cycle. Of course, the control circuit is symmetrical so that for a given resistance presented by transistor 64, triac 45 will be turned on at the same phase angle following the beginning of a half cycle, whether it be negative or positive.

It is apparent that elements 63, 64, 65, 72 and 74 collectively constitute a variable resistance network having a full wave bridge rectifier whose two DC terminals are connected respectively to the collector and emitter of photosensitive transistor 64. The resistance between the two AC terminals of the network (namely the terminals connected to junction 53 and to the ungrounded terminal of capacitor 61) is determined by and is inversely proportional to the amount of light received by the transistor from LED 28.

Of course, when the condenser pressure is at its required level and the temperature of the refrigerant in the condenser coil is at the set point, the charging current for capacitor 61 will be of an appropriate amplitude to drive the fan motors at the necessary speed in order to maintain the refrigerant at that set point temperature. If the temperature, and consequently the head pressure, begin to rise, LED 28 increases its illumination and the amplitude of the charging current increases, thereby causing triac 45 to turn on at an earlier instant (smaller phase angle) following the beginning of each half cycle. The RMS voltage applied to the fan motors therefore increases, with the result that the speed of each motor increases and more air is drawn across the condenser coil. This in turn lowers the refrigerant temperature down to the set point and the condenser pressure down to the required level.

Conversely, if the condensing temperature decreases below the set point temperature and the condenser pressure decreases below its required level, the light emission of LED 28 decreases and the charging current decreases. Triac 45 is therefore fired into conduction at a later time (greater phase angle) following the start of each half cycle and this lowers the RMS voltage applied to the fan motors, causing a reduction in speed thereof. Less air is thus circulated over the condenser coil and the refrigerant temperature is allowed to rise back to the set point and the condenser pressure returns to the required level.

As mentioned herein before, resistors 31 and 32 and diode 33 are preferably included in order to provide desirable wave shaping of the output current of differential amplifier 26. This is done to obtain an overall linear response from temperature sensing thermistor 16 to fan motors 41 – 43. In this way, resistance changes in thermistor 16 are linearly related to speed changes of the fan motors. The compensation introduced by the wave shaping is desired primarily because of the operating characteristics of permanent split capacitance motors.

It is to be particularly noted that a feature of the invention resides in the electrical isolation provided between the relatively high AC line voltage which drives the fan motors and the relatively low DC voltage which energizes the thermistor sensor. Since the thermistor is not at the high line potential, it may be very closely mechanically coupled to the condenser coil so that temperature information is rapidly transmitted thereto. When the thermistor is at line potential, as is the case in previously developed control circuits, much greater electrical insulation must be employed and this introduces undesirable temperature insulation so that it is difficult to closely monitor the temperature changes.

This invention provides, therefore, a unique control system for maintaining a relatively constant condenser pressure in a refrigeration system by regulating the speed of at least one fan motor of an air-cooled condenser coil in response to the condensing temperature, the speed being a direct function of temperature.

While a particular embodiment of the invention has been shown and described, modifications may be made, and it is intended in the appended claims to cover all such modifications as may fall within the true spirit and scope of the invention.

I claim:

1. A control system for modulating the speed of a plurality of parallel-connected, variable speed fan motors, of an air-cooled condenser coil in a refrigeration system, in response to the temperature of the refrigerant in the condenser coil in order to maintain a substantially constant condenser pressure despite wide variations in condenser cooling air temperature, comprising:

an AC power supply for providing an alternating line voltage of relatively high magnitude;

a triac for coupling said AC power supply to the condenser fan motors to effect simultaneous operation thereof in response to gate current supplied to said triac;

a variable resistance network including a full wave bridge rectifier, having a pair of AC terminals and a pair of DC terminals, and a photosensitive transistor having its collector and emitter connected respectively to the two DC terminals of said bridge rectifier, the resistance between the AC terminals of said network being determined by and being inversely proportional to the amount of light received by said transistor;

a timing capacitor coupled in series with the AC terminals of said bridge rectifier;

a frequency compensated capacitive voltage divider coupled to said AC power supply, via a series-connected resistor, for providing a small replica of the line voltage from said AC power supply, said capacitive voltage divider in conjunction with said resistor constituting a dv/dt suppression circuit across said triac;

means for coupling said variable resistance network and said timing capacitor to said capacitive voltage divider to derive therefrom the small replica of the AC line voltage, said capacitor charging during each half cycle of the alternating voltage in response to charging current flowing through said network and of an amplitude determined by the resistance of said network;

a DC power supply, isolated from said AC power supply, for providing a direct voltage of relatively low magnitude;

a temperature sensing thermistor for sensing the refrigerant temperature in the condenser coil;

means, including a differential amplifier, coupled to said DC power supply and to said temperature sensing thermistor for developing a control signal which varies as a function of the difference between a desired set point temperature and the actual sensed temperature of the refrigerant in the condenser coil;

a light emitting diode optically coupled to said photosensitive transistor;

means responsive to said control signal for translating current through said light emitting diode to effect illumination thereof in an amount directly proportional to the sensed temperature of the refrigerant, said timing capacitor thereby charging at a rate directly proportional to the sensed temperature;

and means coupled to said timing capacitor for supplying gate current to said triac during each half cycle at a phase angle inversely proportional to the amplitude of the charging current, thereby simultaneously driving each of the condenser fan motors at a speed directly proportional to the temperature of the refrigerant in the condenser coil.

* * * * *